US010711437B2

(12) United States Patent
Nishiguchi et al.

(10) Patent No.: US 10,711,437 B2
(45) Date of Patent: Jul. 14, 2020

(54) CONSTRUCTION MACHINE

(71) Applicant: Hitachi Construction Machinery Co., Ltd., Taito-ku, Tokyo (JP)

(72) Inventors: Hitoshi Nishiguchi, Tsuchiura (JP); Hidefumi Hiramatsu, Kasumigaura (JP); Tsuyoshi Onozaki, Tsukuba (JP)

(73) Assignee: Hitachi Construction Machinery Co., Ltd., Tokyo (JP)

( * ) Notice: Subject to any disclaimer, the term of this patent is extended or adjusted under 35 U.S.C. 154(b) by 0 days.

(21) Appl. No.: 16/330,325

(22) PCT Filed: Dec. 26, 2017

(86) PCT No.: PCT/JP2017/046721

§ 371 (c)(1),
(2) Date: Mar. 4, 2019

(87) PCT Pub. No.: WO2018/142818

PCT Pub. Date: Aug. 9, 2018

(65) Prior Publication Data

US 2019/0352883 A1 Nov. 21, 2019

(30) Foreign Application Priority Data

Feb. 3, 2017 (JP) ..... 2017-018464

(51) Int. Cl.
*F15B 13/042* (2006.01)
*E02F 9/22* (2006.01)
(Continued)

(52) U.S. Cl.
CPC ..... *E02F 9/2225* (2013.01); *E02F 9/0883* (2013.01); *E02F 9/2267* (2013.01);
(Continued)

(58) Field of Classification Search
CPC ..... F15B 2013/0428; F15B 2211/575; F15B 2211/6355; F15B 2211/67; E02F 9/2285
See application file for complete search history.

(56) References Cited

U.S. PATENT DOCUMENTS 4,165,613 A * 8/1979 Bernhoft ..... E02F 9/2221 414/699
6,530,390 B2 * 3/2003 Nagura ..... F15B 11/0423 137/102

(Continued)

FOREIGN PATENT DOCUMENTS

JP 11-351007 A 12/1999
JP 2006-104836 A 4/2006

(Continued)

OTHER PUBLICATIONS

International Search Report (PCT/ISA/210) issued in PCT Application No. PCT/JP2017/046721 dated Apr. 10, 2018 with English translation (three (3) pages).

(Continued)

*Primary Examiner* — F Daniel Lopez
(74) *Attorney, Agent, or Firm* — Crowell & Moring LLP

(57) ABSTRACT

A bypass line (35) having one end side connected to a pilot delivery line (23) between a pilot pump (16) and a throttle (32) and the other end side connected to the pilot delivery line (23) between a check valve (33) and a pressure reducing valve type pilot valve (25) so as to bypass the throttle (32), a gate lock valve (27), and the check valve (33) provided in order from a pilot pump (16) is provided in the pilot delivery line (23). A lock switching valve (36) shutting down a flow of a pilot pressure oil from the pilot pump (16) through the bypass line (35) at a normal time and allowing the flow of the pilot pressure oil through the bypass line (35) when a pressure generated in the pilot delivery line (23) exceeds a (Continued)

predetermined pressure between the gate lock valve (27) and the check valve (33) is provided in the bypass line (35).

4 Claims, 6 Drawing Sheets

(51) Int. Cl.

| | |
|---|---|
| ***E02F 9/08*** | (2006.01) |
| ***F15B 11/08*** | (2006.01) |
| ***F15B 11/12*** | (2006.01) |
| ***F15B 13/043*** | (2006.01) |
| *E02F 3/32* | (2006.01) |
| *E02F 9/20* | (2006.01) |

(52) U.S. Cl.
CPC ..... *E02F 9/2275* (2013.01); *E02F 9/2285* (2013.01); *F15B 11/08* (2013.01); *F15B 11/126* (2013.01); *F15B 13/0433* (2013.01); *E02F 3/32* (2013.01); *E02F 9/2004* (2013.01); *F15B 2013/0428* (2013.01); *F15B 2211/6355* (2013.01)

(56) References Cited

U.S. PATENT DOCUMENTS

| | | | | |
|---|---|---|---|---|
| 7,165,397 | B2 * | 1/2007 | Raszga | F15B 11/166 60/422 |
| 8,948,983 | B2 * | 2/2015 | Horii | E02F 9/2207 701/50 |

FOREIGN PATENT DOCUMENTS

| | | | |
|---|---|---|---|
| JP | 2013-36270 | A | 2/2013 |
| WO | WO 2015/011832 | A1 | 1/2015 |

OTHER PUBLICATIONS

Japanese-language Written Opinion (PCT/ISA/237) issued in PCT Application No. PCT/JP2017/046721 dated Apr. 10, 2018 (three (3) pages).

* cited by examiner

CONSTRUCTION MACHINE

TECHNICAL FIELD

The present invention relates to a construction machine such as a hydraulic excavator and the like including a gate lock lever for ensuring safety in operation.

BACKGROUND ART

Control lever devices for a working system and a traveling system are provided in the vicinity of an operator's seat in a construction machine such as a hydraulic excavator or the like in general. A gate lock lever manually tilted/operated at an engine start or when an operator gets on/off the operator's seat is provided on an entrance/exit side of the operator's seat. This gate lock lever is a safety device for preventing unintentional operation of an actuator of a working device and a traveling device. In this case, a gate lock switch is switched to open/close by a tilting operation of the gate lock lever, and it is configured to control operation and stop of the entire hydraulic circuit by the gate lock switch (Patent Document 1). In another example, the one in which safety is further improved by providing another unlock switch in addition to the gate lock lever is known (Patent Document 2).

PRIOR ART DOCUMENT

Patent Document

Patent Document 1: Japanese Patent Laid-Open No. 2006-104836 A

Patent Document 2: Japanese Patent Laid-Open No.

SUMMARY OF THE INVENTION

Incidentally, the conventional art according to Patent Document 1 has a problem that, when the gate lock lever is unlocked in a state where a control lever device is at an operation position, the working system or traveling system actuator is operated unintentionally. On the other hand, also in the conventional art according to Patent Document 2, there is a problem that the actuator is operated unintentionally when the gate lock lever and the unlock switch are unlocked in the state where the control lever device is at the operation position. Moreover, in Patent Document 2, a safety system in which the gate lock lever and the unlock switch are provided is configured by using an electric component and a controller. As a result, a huge number of processes are required for ensuring reliability or expensive components are needed and thus, there is a concern that a cost could increase.

The present invention was made in view of the aforementioned problems of the conventional arts and an object of the present invention is to provide a construction machine which can suppress an unintentional operation of actuators of the working system and the traveling system.

A construction machine of the present invention includes a pilot pump constituting a pilot hydraulic source together with a tank; a pressure reducing valve type pilot valve connected to a pilot delivery line of the pilot pump and reducing a pressure of a pilot pressure oil supplied from the pilot delivery line and outputting a pilot pressure to a directional control valve on a main line side; and a gate lock valve provided between the pilot pump and the pressure reducing valve type pilot valve and switching the pressure in the pilot delivery line to either one of a high pressure state by a delivery pressure of the pilot pump or a low pressure state connected to the tank in accordance with an operation of a gate lock lever.

The pilot delivery line includes: a throttle disposed between the pilot pump and the gate lock valve and limiting a flowrate of the pilot pressure oil delivered from the pilot pump; a check valve disposed between the gate lock valve and the pressure reducing valve type pilot valve and allowing a flow of the pilot pressure oil from the pilot pump toward the pressure reducing valve type pilot valve and shutting down the flow in an opposite direction; a bypass line having one end side connected to the pilot delivery line between the pilot pump and the throttle and the other end side connected to the pilot delivery line between the check valve and the pressure reducing valve type pilot valve so as to bypass the throttle, the gate lock valve, and the check valve; a lock switching valve provided in the bypass line and normally shutting down a flow of the pilot pressure oil from the pilot pump into the bypass line and allowing the flow of the pilot pressure oil through the bypass line when a pressure generated in the pilot delivery line exceeds a predetermined pressure between the gate lock valve and the check valve.

According to the present invention, the unintentional operation of the actuators of the working system and the traveling system can be suppressed.

MODE FOR CARRYING OUT THE INVENTION

Hereinafter, the embodiments of a construction machine according to the present invention will be in detail explained referring to the accompanying drawings by taking a case of a hydraulic excavator which is a typical example of the construction machine.

Figure 1:
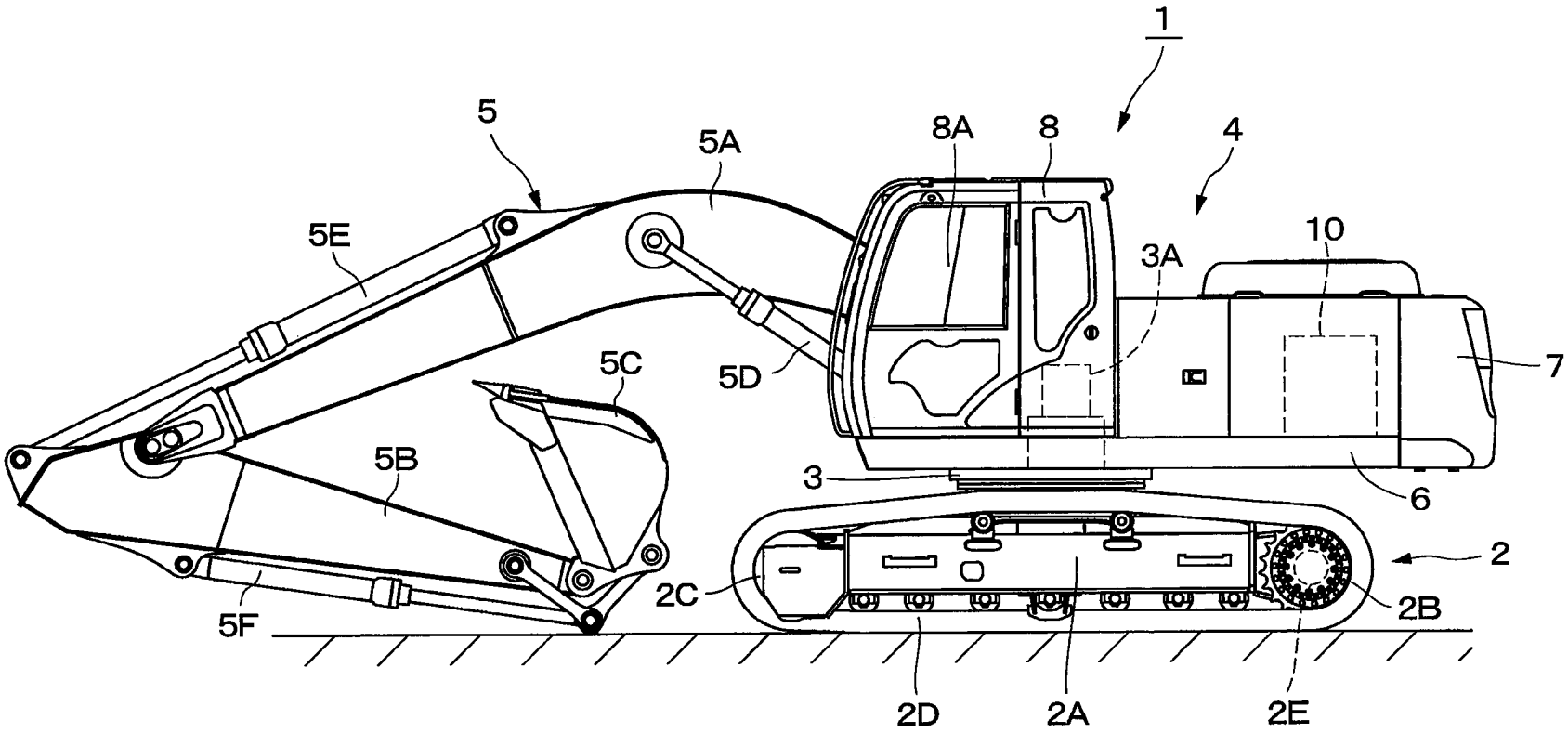
FIG. 1 is a front view showing a hydraulic excavator according to a first embodiment of the present invention.

FIG. 1 to FIG. 4 show a first embodiment of the present invention. In FIG. 1, a hydraulic excavator 1 is constituted by including an automotive crawler-type lower traveling structure 2, a swing circle 3 provided on the lower traveling structure 2, an upper revolving structure 4 mounted on the lower traveling structure 2 through the swing circle 3, capable of swing, and constituting a vehicle body together with the lower traveling structure 2, and a working mechanism 5 mounted on a front side of the upper revolving structure 4, capable of movement upward/downward, and performing an excavating work of earth and sand and the like.

The lower traveling structure 2 is constituted by a truck frame 2A, driving wheels 2B provided on both left and right sides of the truck frame 2A, idler wheels 2C provided on both left and right sides of the truck frame 2A and on sides opposite to the driving wheels 2B in a front and rear direction, and crawler belts 2D wound around the driving wheels 2B and idler wheels 2C (only left side of them is shown). The left and right driving wheels 2B are rotated/driven by left and right traveling hydraulic motors 2E (only left side of them is shown) as hydraulic actuators.

The swing circle 3 is provided on the lower traveling structure 2 and is meshed with a revolving hydraulic motor 3A as a hydraulic actuator including a reduction gear (not shown). This revolving hydraulic motor 3A revolves the upper revolving structure 4 with respect to the lower traveling structure 2.

The working mechanism 5 is constituted by a boom 5A mounted on the front side of the revolving frame 6 of the upper revolving structure 4, capable of an upward/downward operation, an arm 5B mounted on a distal end part of the boom 5A, capable of upward/downward operation, a bucket 5C mounted on a distal end part of the arm 5B, capable of rotational movement, and a boom cylinder 5D, an arm cylinder 5E, and a bucket cylinder 5F made of hydraulic cylinders (hydraulic actuators) driving them.

The revolving frame 6 is to be abase of the upper revolving structure 4 and constitutes a firm support structural body. This revolving frame 6 is mounted on the lower traveling structure 2 through the swing circle 3, capable of swing. A counterweight 7 which takes a weight balance with the working mechanism 5 is provided on a rear end part of the revolving frame 6.

A cab 8 is provided on a front left side of the revolving frame 6. An operator's seat 9 on which an operator is seated is provided in the cab 8. The cab 8 is formed having a box shape surrounding a periphery of the operator's seat 9. A door 8A capable of being opened/closed for the operator to get on/off the cab 8 is provided on a left side surface of the cab 8. A control lever device 13, a gate lock lever 14, an input device 15 and the like which will be described later are disposed on the periphery of the operator's seat 9.

An engine 10 is provided on a rear side of the revolving frame 6, located closer to a front side than the counterweight 7. The engine 10 is mounted on the revolving frame 6 in a laterally placed state with a crank shaft (not shown) extending in a left and right direction. For this engine 10, a diesel engine (internal combustion engine) is used, and this engine 10 constitutes a drive source for rotating/driving a hydraulic pump 11. The hydraulic pump 11 and the pilot pump 16 are mechanically connected on an output side of the engine 10.

The hydraulic pump 11 is rotated/driven by the engine 10. This hydraulic pump 11 constitutes a hydraulic source together with a hydraulic oil tank 12. The hydraulic oil tank 12 constitutes a tank of the present invention. For the hydraulic pump 11, a variable volume swash plate type, an inclined shaft type, or a radial piston type hydraulic pump is used, for example, and a delivery line 18 which will be described later is connected to a delivery side. As a result, the hydraulic pump 11 sucks the hydraulic oil from the hydraulic oil tank 12 and discharges this hydraulic oil as a pressurized oil of high pressure to the delivery line 18. The pressurized oil delivered from the hydraulic pump 11 is supplied to a hydraulic actuator 17 through a directional control valve 20 which will be described later.

Subsequently, the control lever device 13 and the gate lock lever 14 provided in the cab 8 will be described.

Figure 2:
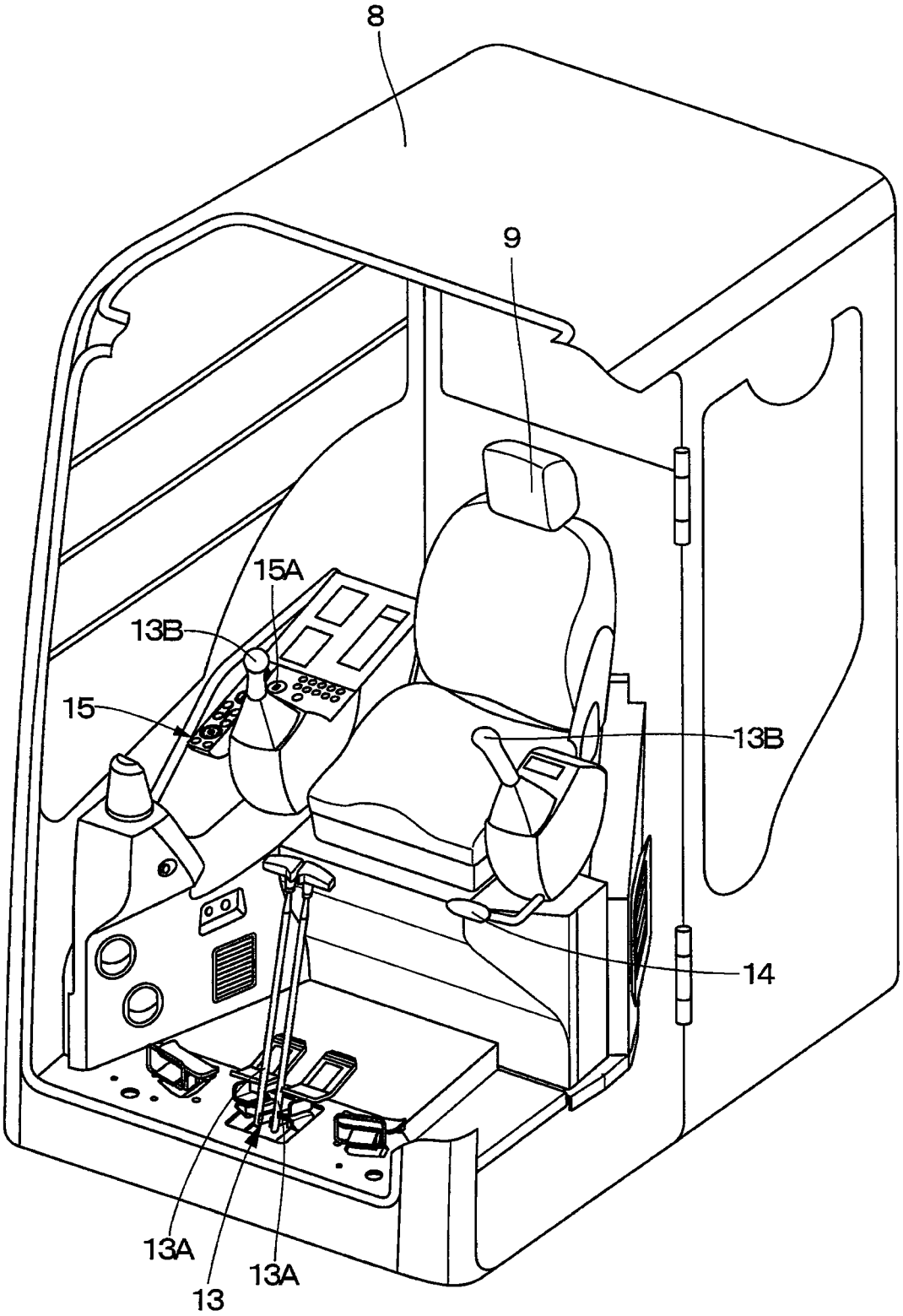
FIG. 2 is a partially cutaway external perspective view showing an inside of a cabin.

As shown in FIG. 2, the control lever device 13 is constituted by including a traveling control lever/pedal 13A disposed on a front side of the operator's seat 9, left and right working control levers 13B disposed on both left and right sides of the operator's seat 9, and a later described pressure reducing valve type pilot valve 25 provided on each of the traveling control lever/pedal 13A, the left and right working control levers 13B. The traveling control lever/pedal 13A is operated when an operation of the traveling hydraulic motor 2E is controlled. The working control lever 13B is operated when an operation of each of the cylinders 5D, 5E, and 5F of the revolving hydraulic motor 3A and the working mechanism 5 is controlled. The traveling control lever/pedal 13A and the left and right control working control levers 13B include a pressure reducing valve type pilot valve 25 which will be described later and supplies the pilot pressure oil to the respective directional control valves 20, respectively.

The gate lock lever 14 is provided on the door 8A side of the cab 8 on the left side of the operator's seat 9. The gate lock lever 14 is switched between a lock position (raising position) and an unlock position (lowering position) by a tilting operation of the operator. The gate lock lever 14 includes a lock switch 30 which will be described later and is mechanically opened/closed by the tilting operation of the gate lock lever 14. As a result, when the gate lock lever 14 is at the lock position, supply of the pilot pressure to the directional control valve 20 is prohibited. On the other hand, when the gate lock lever 14 is at the unlock position, the supply of the pilot pressure to the directional control valve 20 is allowed.

The input device 15 is located in the cab 8 and provided on the right side of the operator's seat 9. A key switch 15A for starting the engine 10 and various operation switches are provided in the input device 15.

Subsequently, system configuration of the hydraulic system controlling the operation of the hydraulic actuator will be described.

The hydraulic pump 11 constitutes a hydraulic source together with the hydraulic oil tank 12 and has a delivery side connected to the delivery line 18. On the other hand, the pilot pump 16 constitutes the pilot hydraulic source together with the hydraulic oil tank 12 and has a pilot delivery line 23 connected to the delivery side. The hydraulic pump 11 and the pilot pump 16 are driven by the engine 10.

The hydraulic actuator 17 is connected to the hydraulic source composed of the hydraulic pump 11 and the hydraulic oil tank 12 through the delivery line 18, the directional control valve 20, and main lines 19A and 19B. In this case, the hydraulic actuator 17 is constituted by including the traveling hydraulic motor 2E, the revolving hydraulic motor 3A, the boom cylinder 5D, the arm cylinder 5E, and the bucket cylinder 5F. A 4-port 3-position hydraulic pilot type directional control valve 20 is provided between the delivery line 18 and the main lines 19A and 19B. In this case, the directional control valve 20 is provided individually on the traveling hydraulic motor 2E, the revolving hydraulic motor 3A, the boom cylinder 5D, the arm cylinder 5E, and the bucket cylinder 5F constituting the hydraulic actuator 17, respectively.

Here, the directional control valve 20 has hydraulic pilot parts 20A and 20B, and these hydraulic pilot parts 20A and 20B are connected to the pressure reducing valve type pilot valve 25 which will be described later by pilot lines 21A and 21B, respectively. When the pilot pressure is not supplied to each of the hydraulic pilot parts 20A and 20B, the directional control valve 20 holds a neutral position (a). On the other hand, when the pilot pressure is supplied to the hydraulic pilot part 20A though the pilot line 21A, the directional control valve 20 is switched to a switching position (b). When the pilot pressure is supplied to the hydraulic pilot part 20B through the pilot line 21B, the directional control valve 20 is switched to a switching position (c).

As a result, the pressurized oil delivered from the hydraulic pump 11 is supplied to the hydraulic actuator 17 through the main lines 19A and 19B, and the hydraulic actuator 17 is operated. The pressurized oil returned to the directional control valve 20 from the hydraulic actuator 17 is returned to the hydraulic oil tank 12 through a return line 22 connecting the directional control valve 20 and the hydraulic oil tank 12.

The pilot delivery line 23 connects the hydraulic oil tank 12 to the pressure reducing valve type pilot valve 25.

Specifically, the pilot delivery line 23 has an upstream side (one side) in a flow direction of the pilot pressure oil connected to the hydraulic oil tank 12 through the pilot pump 16 and a downstream side (the other side) connected to the pressure reducing valve type pilot valve 25. The pilot delivery line 23 is to lead the pilot pressure oil delivered from the pilot pump 16 to the pressure reducing valve type pilot valve 25. The pilot delivery line 23 is constituted by an upstream side line 23A connecting the hydraulic oil tank 12 to a gate lock valve 27 which will be described later and a downstream side line 23B connecting the gate lock valve 27 to the pressure reducing valve type pilot valve 25.

The upstream side line 23A is connected to a deliver side of the pilot pump 16 which pumps up the hydraulic oil in the hydraulic oil tank 12. A filter 24 is provided on the deliver side of the pilot pump 16 in the upstream side line 23A. This filter 24 is to catch various foreign substances (contaminants) such as trash contained in the pilot pressure oil (hydraulic oil) delivered from the pilot pump 16 and to reduce entry of the foreign substances into the pressure reducing valve type pilot valve 25 and the directional control valve 20.

The pressure reducing valve type pilot valve 25 has its high pressure side connected to the downstream side line 23B and the low pressure side connected to the return line 26. This pressure reducing valve type pilot valve 25 constitutes a part of the control lever device 13 and to open/close (to allow or to shut down communication) between the pilot delivery line 23 and the pilot lines 21A and 21B by the tilting operation of the control lever device 13 (the traveling control lever/pedal 13A and the working control lever 13B).

That is, the pressure reducing valve type pilot valve 25 is to reduce a pressure of the pilot pressure oil supplied from the pilot delivery line 23 and to output the pilot pressure to the hydraulic pilot parts 20A and 20B of the directional control valves 20 provided on the main lines 19A and 19B side. The pilot pressure oil returned from the hydraulic pilot parts 20A and 20B to the pressure reducing valve type pilot valve 25 is returned to the hydraulic oil tank 12 through a return line 26 connecting the low pressure side of the pressure reducing valve type pilot valve 25 and the hydraulic oil tank 12.

The gate lock valve 27 is located between the pilot pump 16 and the pressure reducing valve type pilot valve 25 and is provided in the pilot delivery line 23. This gate lock valve 27 is constituted by a 3-port 2-position electromagnetic directional control valve and is provided between the upstream side line 23A and the downstream side line 23B of the pilot delivery line 23. The gate lock valve 27 is switched to demagnetized position (d) and an excited position (e) by the tilting operation of the gate lock lever 14.

Specifically, the gate lock valve 27 is connected to a battery 29 through a lead wire 28 and is switched between the demagnetized position (d) and the excited position (e) by opening/closing of a lock switch 30 provided on the lead wire 28. In this case, the lock switch 30 is provided on the gate lock lever 14. The lock switch 30 is constituted by a mechanical switch interlocked with the operation of the gate lock lever 14, for example, and is opened/closed by the tilting operation of the gate lock lever 14.

Figure 3:
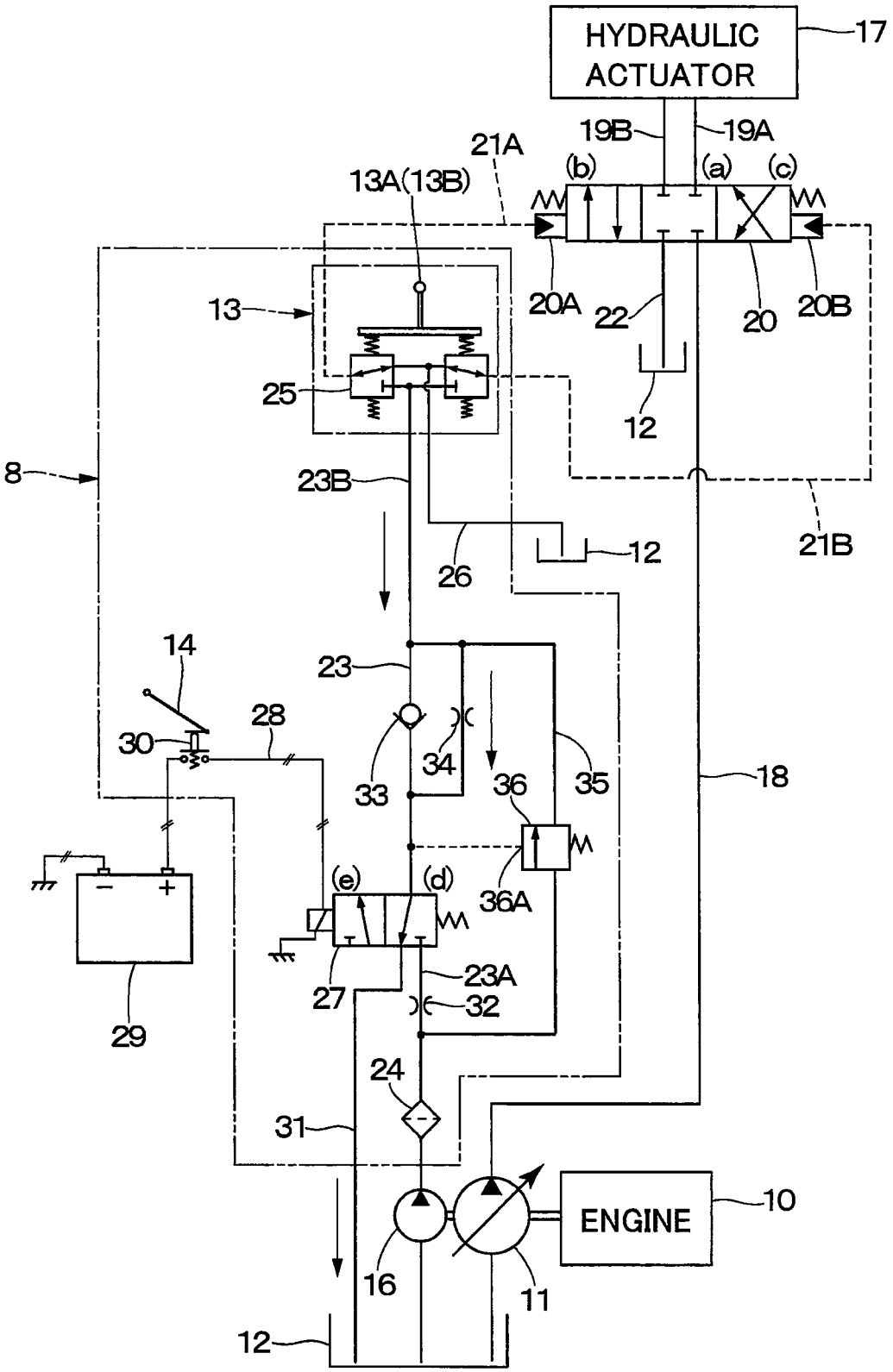
FIG. 3 is a system configuration diagram when a gate lock lever is at a lock position.
Figure 4:
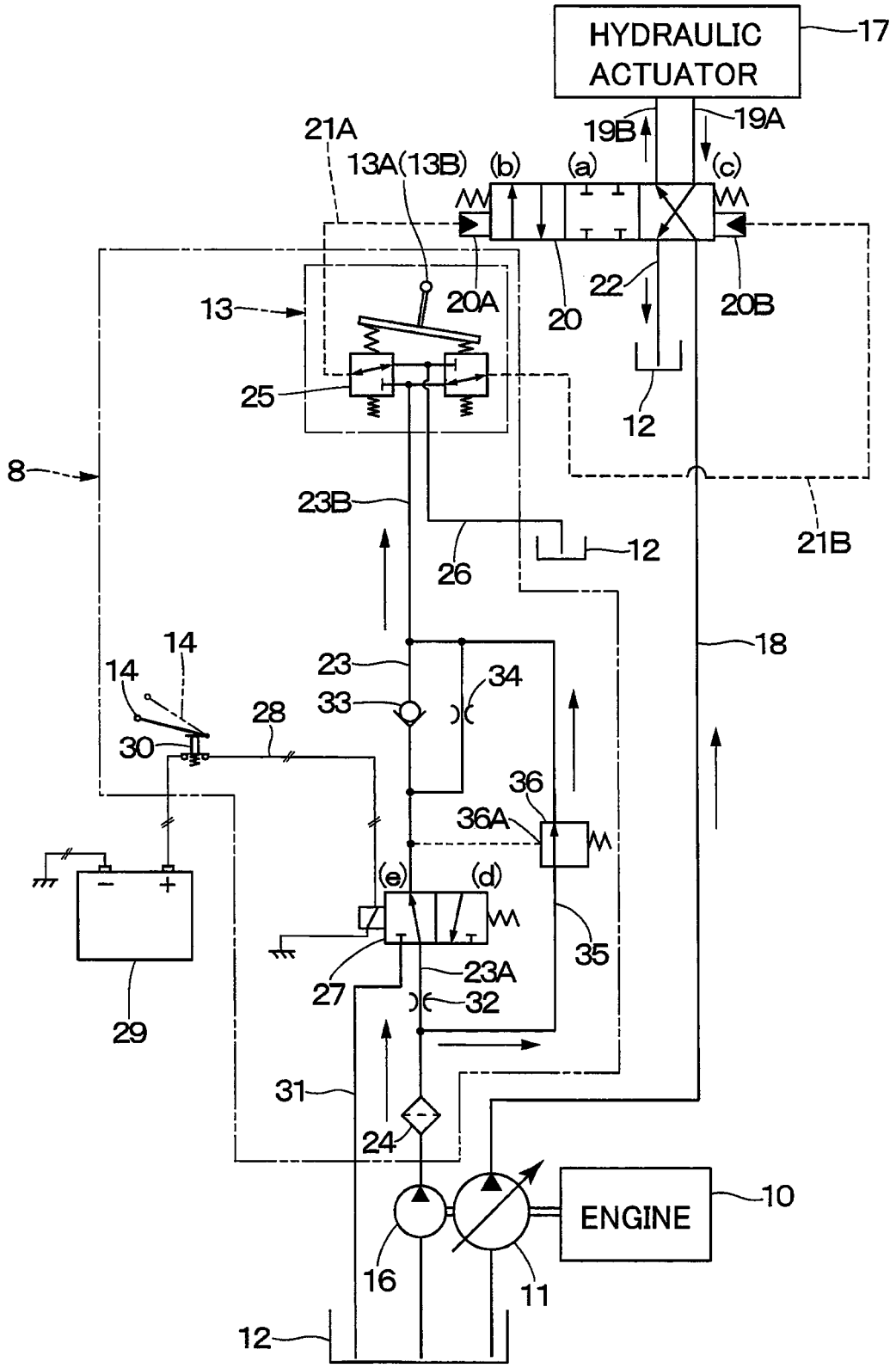
FIG. 4 is a system configuration diagram when the gate lock lever is at an unlock position and when a control lever is at the operation position.

That is, as shown in FIG. 3, the lock switch 30 is opened and is brought into a non-conducted state when the gate lock lever 14 is lifted up to the lock position and brings the gate lock valve 27 to the demagnetized position (d). On the other hand, as shown in FIG. 4, the lock switch 30 is closed and is brought into a conducted state when the gate lock lever 14 is lowered from the lock position to the unlock position and switches the gate lock valve 27 to the excited position (e).

When the gate lock valve 27 is at the demagnetized position (d), the downstream side line 23B of the pilot delivery line 23 is connected to the pilot return line 31 connecting the gate lock valve 27 to the hydraulic oil tank 12. As a result, the downstream side line 23B is switched to a low pressure state. On the other hand, when the gate lock valve 27 is in the excited position (e), the upstream side line 23A and the downstream side line 23B of the pilot delivery line 23 are connected. As a result, the downstream side line 23B is switched to a high pressure state.

That is, the gate lock valve 27 is to switch the pressure in the pilot delivery line 23 to either one of the high pressure state by the delivery pressure of the pilot pump 16 or the low pressure state connected to the hydraulic oil tank 12 in accordance with the operation of the gate lock lever 14. In this case, the low pressure state is a pressure state where the directional control valve 20 cannot be switched to neither of the switching position (b) nor the switching position (c) from the neutral position (a). On the other hand, the high pressure state is a pressure state where the directional control valve 20 can be switched to either one of the switching position (b) or the switching position (c) from the neutral position (a).

The throttle 32 is located between the pilot pump 16 and the gate lock valve 27 and is provided on the upstream side line 23A of the pilot delivery line 23. This throttle 32 is to limit a flowrate of the pilot pressure oil delivered from the pilot pump 16. That is, the throttle 32 is to limit the flowrate of the pilot pressure oil flowing through the downstream side line 23B when the gate lock valve 27 is switched to the excited position (e). As a result, when the gate lock valve 27 is switched to the excited position (e), the pressure generated in the downstream side line 23B is configured to be gradually increased.

The throttle 32 is provided so that delay time can be given since the gate lock valve 27 was switched to the excited position (e) until the pressure generated in the downstream side line 23B reaches a predetermined pressure. In this case, the delay time is set to a period of time since the operator seated on the operator's seat 9 lowers the gate lock lever 14 from the lock position to the unlock position until the operator operates the control lever device 13 (the traveling control lever/pedal 13A or the working control lever 13B). That is, the delay time is set within a range of 0.5 to 3.0 seconds, for example, by considering a hole diameter of the throttle 32 and a length of the pilot delivery line 23.

When the pressure generated in the downstream side line 23B exceeds the predetermined pressure, a lock switching valve 36, which will be described later, is switched and the downstream side line 23B can be kept in the high pressure state. As a result, when the operator is to operate the hydraulic excavator 1, the pilot delivery line 23 can be brought into the high pressure state and thus, the operator can operate the hydraulic excavator 1 without feeling a sense of discomfort.

Moreover, the throttle 32 is provided in the vicinity of the operator's seat 9 in the cab 8. Here, in the delay time, since there is a pressure difference between the upstream side line 23A and the downstream side line 23B, a whistling sound (blow sound) is generated when the pilot pressure oil delivered from the pilot pump 16 flows through the throttle 32. The operator can recognize that the gate lock lever 14 is at the unlock position by this whistling sound. While the whistling sound is generated, the downstream side line 23B is not in the high pressure state and thus, the operator can recognize that the control lever device 13 is in an inoperable state.

The check valve 33 is located between the gate lock valve 27 and the pressure reducing valve type pilot valve 25 and is provided in the downstream side line 23B of the pilot delivery line 23. This check valve 33 is to allow the flow of the pilot pressure oil from the pilot pump 16 toward the pressure reducing valve type pilot valve 25 and shuts down the flow in the opposite direction.

Another throttle 34 is provided in parallel with the check valve 33 in front and rear (upstream side and downstream side) of the check valve 33. The another throttle 34 constitutes a slow return valve together with the check valve 33. The throttle 34 is to allow the flow of the pilot pressure oil closer to the downstream side than the check valve 33 toward the gate lock valve 27 when the gate lock valve 27 is switched to the demagnetized position (d). As a result, when the gate lock valve 27 is switched from the excited position (e) to the demagnetized position (d), the pilot pressure between the check valve 33 and the pressure reducing valve type pilot valve 25 can be returned to the low pressure state.

A bypass line 35 has one end side (upstream side) connected to the upstream side line 23A of the pilot delivery line 23 between the pilot pump 16 and the throttle 32 and the other end side (downstream side) connected to the downstream side line 23B of the pilot delivery line 23 between the check valve 33 and the pressure reducing valve type pilot valve 25. That is, the bypass line 35 connects the upstream side line 23A to the downstream side line 23B so as to bypass the throttle 32, the gate lock valve 27, and the check valve 33.

The lock switching valve 36 is provided in the bypass line 35. This lock switching valve 36 is constituted by a pressure control valve, and a pressure receiving part 36A detects a pressure in the downstream side line 23B of the pilot delivery line 23. The lock switching valve 36 normally closes the valve and shuts down the flow of the pilot pressure oil from the pilot pump 16 into the bypass line 35. On the other hand, the lock switching valve 36 is opened when the pressure generated in the pilot delivery line 23 (downstream side line 23B) between the gate lock valve 27 and the check valve 33 exceeds a predetermined pressure (pressure threshold value) and allows the flow of the pilot pressure oil through the bypass line 35.

That is, the lock switching valve 36 shuts down the bypass line 35 by closing the valve when the gate lock lever 14 is at the lock position and until the pressure of the downstream side line 23B exceeds the predetermined pressure since the gate lock lever 14 is lowered from the lock position to the unlock position. On the other hand, the lock switching valve 36 opens the valve and switches the bypass line 35 to a flow state when the pressure in the downstream side line 23B exceeds the predetermined pressure.

The pressure in the downstream side line 23B reaches the predetermined pressure when predetermined time (delay time) has elapsed since the gate lock valve 27 is switched from the demagnetized position (d) to the excited position (e) by the throttle 32 provided in the upstream side line 23A. The lock switching valve 36 is switched to the position allowing the flow of the pilot pressure oil through the bypass line 35 when the pressure receiving part 36A detects the predetermined pressure.

As a result, after the predetermined time has elapsed since the gate lock lever 14 is tilted/operated from the lock position to the unlock position, the pilot pressure oil from the pilot pump 16 can be led to the downstream side line 23B through the bypass line 35, and it is configured that the downstream side line 23B can be continuously held in the high pressure state after that.

The hydraulic excavator 1 according to the first embodiment has the aforementioned configuration and its operation will be described subsequently.

First, the operator gets on the cab 8 and is seated on the operator's seat 9 and operates the key switch 15A so as to start the engine 10. The operator switches the gate lock lever 14 from the lock position to the unlock position and closes the lock switch 30. As a result, the gate lock valve 27 is brought into the conducted state with the battery 29 through the lead wire 28 and is switched from the demagnetized position (d) to the excited position (e).

As a result, the upstream side line 23A and the downstream side line 23B of the pilot delivery line 23 are brought into the communicating state, and the pilot pressure oil is supplied from the pilot pump 16 to the downstream side line 23B. After that, by performing the switching operation of the pressure reducing valve type pilot valve 25 through the tilting operation of the control lever device 13, the pilot pressure oil is supplied to the hydraulic pilot parts 20A and 20B of the directional control valve 20 through the pilot lines 21A and 21B. As a result, the directional control valve 20 is switched from the neutral position (a) to either one of the switching position (b) or the switching position (c), and the pressurized oil from the hydraulic pump 11 is supplied to the hydraulic actuator 17 through the directional control valve 20 in accordance with the tilting operation to the control lever device 13. As a result, the hydraulic excavator 1 performs a traveling operation by the lower traveling structure 2, a revolving operation by the upper revolving structure 4, and an excavating operation by the working mechanism 5 and the like.

Incidentally, in the conventional art according to the aforementioned Patent Document 1, there is a problem that, if the gate lock lever is unlocked in a state where the control lever device is at the operation position, the actuators of the working system and the traveling system are operated unintentionally. On the other hand, in the conventional art according to Patent Document 2, too, there is a problem that if the gate lock lever and the unlock switch are cancelled in a state where the control lever device is at the operation position, the actuator is operated unintentionally. On the other hand, the safety system on which the gate lock lever and the unlock switch are provided is configured by using the electric components and the controller. As a result, a huge number of processes are required for ensuring reliability or expensive components are needed and thus, there is a concern that a cost could increase.

Thus, the first embodiment is configured such that the predetermined elapsed time is provided until the downstream side line 23B of the pilot delivery line 23 is brought into the high pressure state since the gate lock lever 14 is lowered from the lock position to the unlock position. As a result, even if the gate lock lever 14 is lowered from the lock position to the unlock position in the state where the control lever device 13 is at the operation position, unintentional operation of the hydraulic actuators 17 of the working system and the traveling system can be delayed.

Subsequently, system configuration according to the first embodiment will be described by referring to FIG. 3 and FIG. 4.

First, as shown in FIG. 3, when the gate lock lever 14 is at the lock position, the lock switch 30 is opened, and the gate lock valve 27 is at the demagnetized position (d). In this case, the downstream side line 23B of the pilot delivery line 23 communicates with the pilot return line 31, and the pilot pressure oil in the downstream side line 23B is returned to the hydraulic oil tank 12. Accordingly, the pilot pressure in the downstream side line 23B becomes smaller than the predetermined pressure, and the lock switching valve 36 shuts down the bypass line 35.

As a result, since the downstream side line 23B is held in the low pressure state, even if the control lever device 13 is tilted/operated, the directional control valve 20 is held at the neutral position (a). As a result, the pressurized oil from the hydraulic pump 11 is not supplied to the hydraulic actuator 17 through the directional control valve 20, and the hydraulic actuator 17 is not operated.

Subsequently, as shown in FIG. 4, when the gate lock lever 14 is lowered from the lock position to the unlock position, the lock switch 30 is closed, and electricity is supplied to the gate lock valve 27 from the battery 29. As a result, the gate lock valve 27 is switched from the demagnetized position (d) to the excited position (e), and the upstream side line 23A and the downstream side line 23B of the pilot delivery line 23 are brought into the communicating state.

Here, the throttle 32 for limiting the flowrate of the pilot pressure oil delivered from the pilot pump 16 is provided in the upstream side line 23A. This throttle 32 is provided so that the pressure in the downstream sideline 23B gradually rises when the gate lock valve 27 is switched to the excited position (e). The bypass line 35 is connected between the upstream side line 23A and the downstream side line 23B so as to bypass the throttle 32, the gate lock valve 27, and the check valve 33. The lock switching valve 36 provided in the bypass line 35 is switched from the shut-down state to the communicating state when the pressure in the downstream side line 23B exceeds the predetermined pressure (pressure threshold value).

As a result, the pilot pressure oil delivered from the pilot pump 16 can be made to flow through the downstream side line 23B from the upstream side line 23A through the bypass line 35, and the downstream side line 23B can be brought into the high pressure state. After that, the hydraulic actuator 17 can be operated by operating the control lever device 13.

As described above, when the gate lock lever 14 is tilted/operated from the lock position to the unlock position, rising of the pressure in the downstream side line 23B to the high pressure state at once is suppressed by the throttle 32. In this case, with regard to the throttle 32, time (elapsed time) until the pressure in the downstream side line 23B becomes the predetermined pressure is set within a range of 0.5 to 3.0 seconds, for example, or more specifically, to any one of 0.5, 1.0, 1.5, 2.0, 2.5 and 3.0 seconds (preferably 2.0 seconds). As a result, when the operator seated on the operator's seat 9 lowers the gate lock lever 14 from the lock position to the unlock position and then, moves to an operation posture for operating the control lever device 13, the hydraulic excavator 1 can be operated without interfering the operator's operation since the inside of the downstream side line 23B is held in the high pressure state.

Moreover, the throttle 32 is disposed in the vicinity of the operator's seat 9 and is configured to emit a whistling sound until the pressure in the downstream side line 23B becomes the predetermined pressure. As a result, the operator can recognize that the gate lock lever 14 has been tilted/operated from the lock position to the unlock position and that the hydraulic excavator 1 is in an operation preparation state by the whistling sound.

Subsequently, a case where the gate lock lever 14 is lowered from the lock position to the unlock position in a state where the control lever device 13 has been tilted/operated to the operation position without an intention of the operator will be described.

After the gate lock valve 27 is switched from the demagnetized position (d) to the excited position (e), the pilot pressure oil flows from the pilot pump 16 toward the downstream side line 23B, but the inside of the downstream side line 23B is not brought into the high pressure state unless 2.0 seconds, for example, have elapsed by the throttle 32. Accordingly, the operation of the hydraulic actuator 17 not intended by the operator can be suppressed. Moreover, since the operator has moved to the operation posture of the control lever device 13 during this period, the operator can notice that the control device 13 is at the unintended operation position. As a result, since the operation of the hydraulic excavator 1 not intended by the operator can be suppressed, safety can be improved.

When the gate lock lever 14 is raised from the unlock position to the lock position after the work is finished, the lock switch 30 is opened, and the gate lock valve 27 is returned from the excited position (e) to the demagnetized position (d). As a result, the downstream side line 23B communicates with the pilot return line 31 and thus, the pilot pressure oil in the downstream side line 23B is returned to the hydraulic oil tank 12. As a result, the pressure in the downstream side line 23B becomes smaller than the predetermined pressure, and the lock switching valve 36 switches the bypass line 35 to the shut-down state.

Thus, according to the first embodiment, after the predetermined time has elapsed since the gate lock lever 14 was lowered from the lock position to the unlock position, the hydraulic actuator 17 is brought into a state capable of operation. As a result, even if the gate lock lever 14 is lowered from the lock position to the unlock position without noticing that the control lever device 13 (traveling control lever/pedal 13A and the working control lever 13B) is at the operation position, an immediate operation of the hydraulic excavator 1 can be suppressed, and thus, safety of the work with the hydraulic excavator 1 can be improved.

The elapsed time until the operation of the hydraulic actuator 17 is made possible since the gate lock lever 14 was lowered from the lock position to the unlock position is set to a period of time from when the operator lowered the gate lock lever 14 to the unlock position until the operator takes the operation posture for operating the control lever device 13 (within a range from 0.5 to 3.0 seconds, for example). As a result, since the operator can notice that the control lever device 13 is at the operation position before the hydraulic excavator 1 is operated since the gate lock lever 14 was lowered to the unlock position, safety of the work of the hydraulic excavator 1 can be improved.

Moreover, by setting the elapsed time to 0.5 to 3.0 seconds, in a state where the control lever device 13 is at the neutral position, the work of hydraulic excavator 1 can be started without giving waiting time to the operator. As a result, since the work of the hydraulic excavator 1 can be started smoothly, reliability can be improved.

In this case, it is configured that the whistling sound is emitted when the pilot pressure oil flows through the throttle 32 in the elapsed time. By hearing this whistling sound, the operator can recognize that the gate lock lever 14 is at the unlock position and that the operation of the hydraulic excavator 1 is in preparation.

Figure 5:
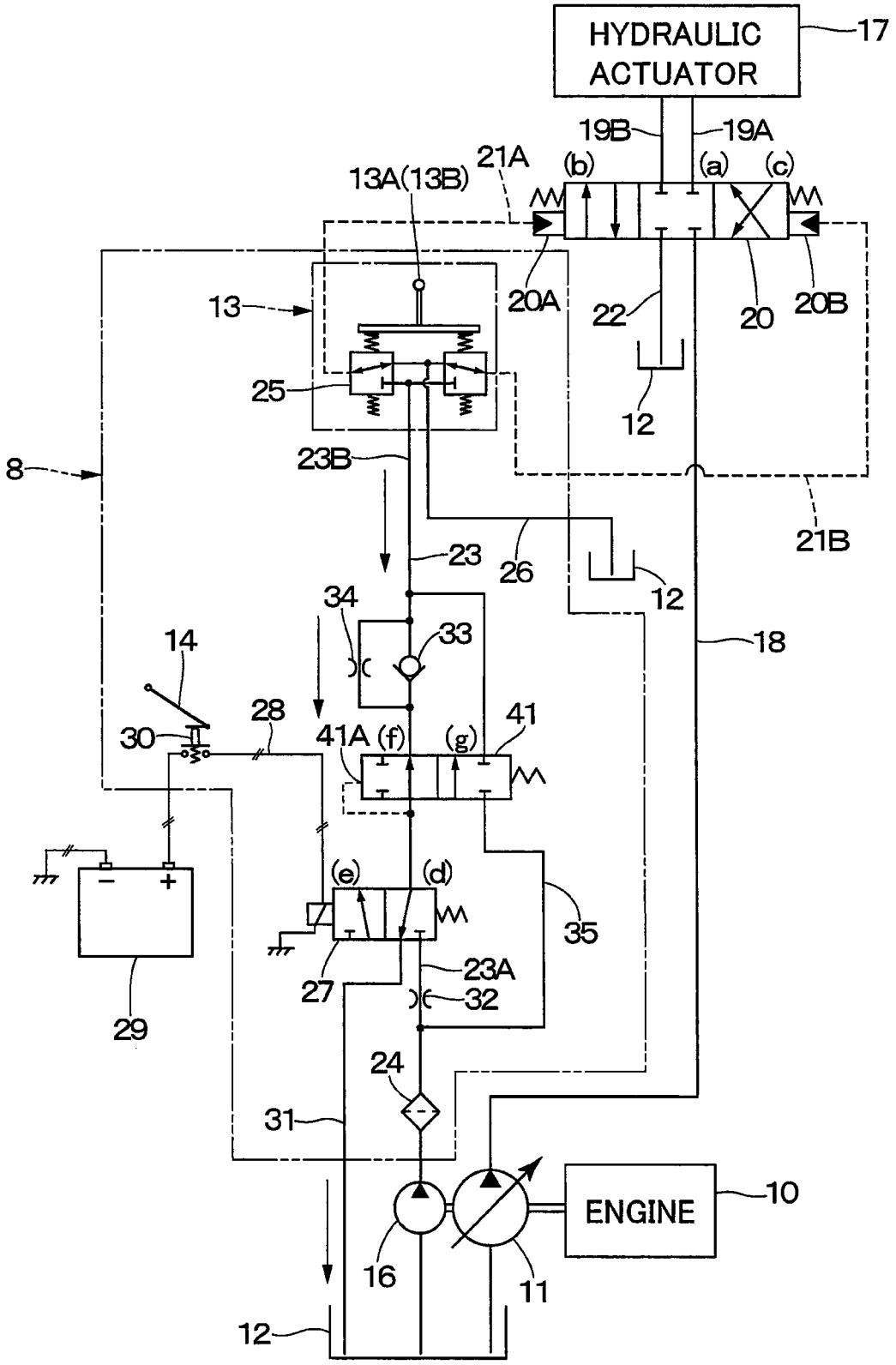
FIG. 5 is a system configuration diagram when the gate lock lever is at a lock position according to a second embodiment of the present invention.
Figure 6:
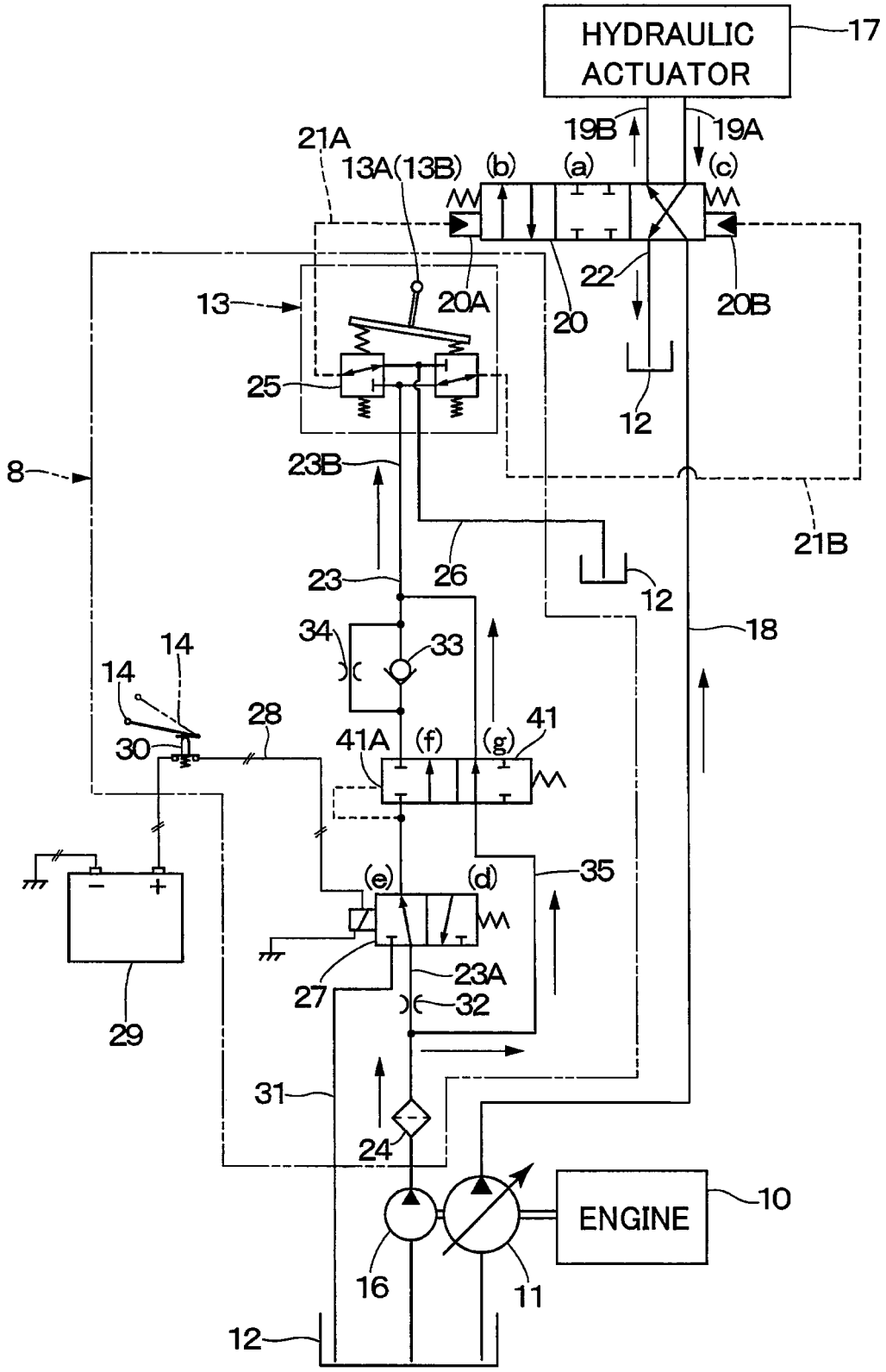
FIG. 6 is a system configuration diagram when the gate lock lever is at the unlock position and when the control lever is at the operation position.

Subsequently, FIG. 5 and FIG. 6 show a second embodiment of the present invention. A characteristic feature of the second embodiment is that the lock switching valve is provided across the bypass line and the pilot delivery line. It should be noted that in the second embodiment, the same reference numerals are given to the same constituent elements as those in the aforementioned first embodiment and the description will be omitted.

The lock switching valve 41 is used instead of the lock switching valve 36 according to the first embodiment and is provided as a single valve across the bypass line 35 and the pilot delivery line 23. This lock switching valve 41 is configured as a 4-port 2-position pressure control valve and is configured to be switched when a pressure receiving part 41A for receiving the pressure of the downstream side line 23B of the pilot delivery line 23 detects a predetermined pressure.

Specifically, the lock switching valve 41 is normally at an initial position (f) and allows a flow of the pilot pressure oil from the pilot pump 16 through the pilot delivery line 23 and shuts down the flow of the pilot pressure oil through the bypass line 35. On the other hand, when the pressure generated in the pilot delivery line 23 (downstream side line 23B) exceeds the predetermined pressure between the gate lock valve 27 and the check valve 33, the lock switching valve 41 is switched from the initial position (f) to the switching position (g) and shuts down the flow of the pilot pressure oil through the pilot delivery line 23, and the pilot pressure oil is supplied from the bypass line 35 to the pressure reducing valve type pilot valve 25.

That is, as shown in FIG. 5, when the gate lock lever 14 is at the lock position (raising position), a space between the battery 29 and the gate lock valve 27 is brought into the non-conducted state, and the gate lock valve 27 is at the demagnetized position (d). Accordingly, the downstream side line 23B of the pilot delivery line 23 communicates with the pilot return line 31 and in the low pressure state. As a result, the lock switching valve 41 is at the initial position (f) and causes the upstream side line 23A to communicate with the downstream side line 23B and shuts down the bypass line 35.

As shown in FIG. 6, when the gate lock lever 14 is lowered to the unlock position (lowering position), a space between the battery 29 and the gate lock valve 27 is brought into the conducted state, and the gate lock valve 27 is at the excited position (e). Accordingly, the downstream side line 23B of the pilot delivery line 23 communicates with the upstream side line 23A of the pilot delivery line 23.

As a result, it is configured such that the pilot pressure oil delivered from the pilot pump 16 flows out into the downstream side line 23B, and when the pressure in the downstream side line 23B exceeds the predetermined pressure (pressure threshold value), the lock switching valve 41 is switched to the switching position (g). In this case, the pressure in the downstream side line 23B gradually increases to the predetermined pressure by the throttle 32 provided in the upstream side line 23A. The time until the pressure in the downstream side line 23B reaches the predetermined pressure is after the predetermined time (delay time) has elapsed since the gate lock lever 14 is lowered from the lock position to the unlock position (within a range from 0.5 to 3.0 seconds, for example). The predetermined time is set by considering the hole diameter of the throttle 32 and the length of the pilot delivery line 23.

The lock switching valve 41 is switched from the initial position (f) to the switching position (g) and shuts down between the upstream side line 23A and the downstream side line 23B and causes the bypass line 35 to communicate with the pilot pump 16 without through the throttle 32 when the pressure in the downstream side line 23B exceeds the predetermined pressure. As a result, the pilot pressure oil delivered from the pilot pump 16 flows toward the upstream side line 23A from the bypass line 35 bypassing the throttle 32, the gate lock valve 27, the lock switching valve 41, and the check valve 33. As a result, it is configured such that the inside of the downstream side line 23B can be held in the high pressure state.

Thus, the actions and effects similar to those in the first embodiment can also be exerted in the second embodiment. Particularly, according to the second embodiment, when the predetermined time has elapsed since the gate lock valve 27 is switched to the excited position (e), the pilot pressure of the pilot pump 16 acts on the pressure receiving part 41A of the lock switching valve 41 at all times and thus, the lock switching valve 41 maintains the state of being switched to the switching position (g). Then, when the control lever device 13 is tilted/operated in order to perform the work of the hydraulic excavator 1, the pilot pressure oil is made to flow only through the bypass line 35 and is supplied to the pressure reducing valve type pilot valve 25. As a result, the pressure fluctuation when the control lever device 13 is operated acting on the pressure receiving part 41A of the lock switching valve 41 can be reduced.

It should be noted that in the first embodiment, the case where the fact that the gate lock lever 14 is tilted/operated from the lock position to the unlock position and that the hydraulic excavator 1 is in the operation preparation state is notified by the whistling sound of the pilot pressure oil flowing through the throttle 32 is described as an example. However, the present invention is not limited to that and it may be so configured that a pressure sensor (differential pressure sensor) for detecting a differential pressure between the upstream side and the downstream side of the throttle 32 is provided, for example, and when this pressure sensor detects a predetermined pressure, it is notified to the operator by emitting an alarm sound or making display on a display in the cab or the like. The same applies to the second embodiment.

In the embodiments, the automotive crawler-type hydraulic excavator 1 is used as an example of the construction machine in the description. However, the present invention is not limited to that but can be widely applied to various types of construction machines including a gate lock lever such as an automotive wheel-type hydraulic excavator, a movable crane and the like.

DESCRIPTION OF NUMERALS

1: Hydraulic excavator (Construction machine)
12: Hydraulic oil tank (Tank)
14: Gate lock lever
16: Pilot pump
19A, 19B: Main line
20: Directional control valve
23: Pilot delivery line

25: Pressure reducing valve type pilot valve
27: Gate lock valve
32: Throttle
33: Check valve
34: Another throttle
35: Bypass line
36, 41: Lock switching valve

The invention claimed is:

1. A construction machine comprising:

a pilot pump constituting a pilot hydraulic source together with a tank;

a pressure reducing valve type pilot valve connected to a pilot delivery line of the pilot pump and reducing a pressure of a pilot pressure oil supplied from the pilot delivery line and outputting a pilot pressure to a directional control valve on a main line side; and a gate lock valve provided between the pilot pump and the pressure reducing valve type pilot valve and switching the pressure in the pilot delivery line to either one of a high pressure state by a delivery pressure of the pilot pump or a low pressure state connected to the tank in accordance with an operation of a gate lock lever, characterized in that:

the pilot delivery line includes:

a throttle disposed between the pilot pump and the gate lock valve and limiting a flowrate of the pilot pressure oil delivered from the pilot pump;

a check valve disposed between the gate lock valve and the pressure reducing valve type pilot valve and allowing a flow of the pilot pressure oil from the pilot pump toward the pressure reducing valve type pilot valve and shutting down the flow in an opposite direction;

a bypass line having one end side connected to the pilot delivery line between the pilot pump and the throttle and the other end side connected to the pilot delivery line between the check valve and the pressure reducing valve type pilot valve so as to bypass the throttle, the gate lock valve, and the check valve;

a lock switching valve provided in the bypass line and normally shutting down a flow of the pilot pressure oil from the pilot pump into the bypass line and allowing the flow of the pilot pressure oil through the bypass line when a pressure generated in the pilot delivery line exceeds a predetermined pressure between the gate lock valve and the check valve.

2. The construction machine according to claim 1, wherein the lock switching valve is provided across the bypass line and the pilot delivery line and is configured to allow the flow of the pilot pressure oil from the pilot pump through the pilot delivery line and to shut down the flow of the pilot pressure oil through the bypass line at normal time, and when the pressure generated in the pilot delivery line exceeds the predetermined pressure between the gate lock valve and the check valve, to shut down the flow of the pilot pressure oil through the pilot delivery line, and the pilot pressure oil is supplied from the bypass line to the pressure reducing valve type pilot valve.

3. The construction machine according to claim 1, wherein the throttle is configured such that a period of time until a pressure generated in the pilot delivery line reaches the predetermined pressure between the gate lock valve and the check valve is within a range from 0.5 to 3.0 seconds.

4. The construction machine according to claim 1, wherein another throttle is provided in parallel with the check valve in front and rear of the check valve.

* * * * *